US011519592B2

(12) United States Patent
Qi et al.

(10) Patent No.: US 11,519,592 B2
(45) Date of Patent: Dec. 6, 2022

(54) LIGHTING ASSEMBLY AND LIGHTING LAMP

(71) Applicant: OPPLE LIGHTING CO., LTD., Shanghai (CN)

(72) Inventors: Xingzhou Qi, Shanghai (CN); Jian Yu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/136,206

(22) Filed: Dec. 29, 2020

(65) Prior Publication Data

US 2021/0116119 A1 Apr. 22, 2021

Related U.S. Application Data

(63) Continuation of application No. PCT/CN2019/118589, filed on Nov. 14, 2019.

(30) Foreign Application Priority Data

Nov. 15, 2018 (CN) ..... 201821877735.2

(51) Int. Cl.
*F21V 23/06* (2006.01)
*F21S 6/00* (2006.01)
(Continued)

(52) U.S. Cl.
CPC ..... *F21V 23/06* (2013.01); *F21S 6/003* (2013.01); *F21V 21/14* (2013.01); *F21V 31/005* (2013.01); *H01R 33/22* (2013.01); *F21Y 2105/18* (2016.08)

(58) Field of Classification Search
CPC ..... F21V 23/06; F21V 21/14; F21V 31/005; F21V 21/30; F21S 6/003; H01R 33/22; H01R 39/64; F21Y 2105/18
See application file for complete search history.

(56) References Cited

U.S. PATENT DOCUMENTS 5,091,834 A * 2/1992 Kao ..... F21S 6/003 362/648
8,690,606 B2 4/2014 Kalavitz
(Continued)

FOREIGN PATENT DOCUMENTS

CN 203115794 U 8/2013
CN 104613359 A 5/2015
(Continued)

OTHER PUBLICATIONS

International Search Report of PCT Application No. PCT/CN2019/118589 dated Feb. 19, 2019 with English translation, (4p).

*Primary Examiner* — Tsion Tumebo
(74) *Attorney, Agent, or Firm* — Arch & Lake LLP

(57) ABSTRACT

A lighting assembly and a lighting lamp. The lighting assembly includes a light source assembly and a connection assembly. The light source assembly includes a casing, a light source plate arranged on the casing, light emitting units arranged on the light source plate, and a first electrical terminal electrically connected with the light source plate. The first electrical terminal is connected to the casing. The connection assembly includes a bracket, a connection rod mounted inside the bracket, and a second electrical terminal arranged at an end of the connection rod. The first electrical terminal and the second electrical terminal are in plugging and running fit to supply power to the light emitting units. A rotating shaft of the light source assembly and the connection assembly is parallel to an axis of the connection rod.

16 Claims, 4 Drawing Sheets

(51) Int. Cl.

| | |
|---|---|
| ***F21V 21/14*** | (2006.01) |
| ***F21V 31/00*** | (2006.01) |
| ***H01R 33/22*** | (2006.01) |
| ***F21Y 105/18*** | (2016.01) |

(56) References Cited

U.S. PATENT DOCUMENTS

| | | | | |
|---|---|---|---|---|
| 9,232,846 | B2 * | 1/2016 | Fung | A45D 42/10 |
| 9,719,641 | B1 * | 8/2017 | Volek | F21V 23/02 |
| 10,072,804 | B2 | 9/2018 | Deng et al. | |
| 10,900,640 | B2 * | 1/2021 | Xia | F21V 14/02 |
| 11,371,692 | B2 * | 6/2022 | Yang | G02B 6/0096 |
| 2008/0238323 | A1 * | 10/2008 | Chan | H05K 3/284 315/35 |
| 2010/0315801 | A1 * | 12/2010 | Wu | F21S 6/003 362/257 |
| 2013/0329431 | A1 * | 12/2013 | Lin | F21S 6/003 362/253 |
| 2014/0003069 | A1 * | 1/2014 | Polick | F21S 6/00 362/427 |
| 2015/0276204 | A1 * | 10/2015 | Ray | F21S 6/001 239/20 |
| 2018/0058647 | A1 * | 3/2018 | He | F21V 21/116 |
| 2020/0332986 | A1 * | 10/2020 | Xia | F21V 21/10 |

FOREIGN PATENT DOCUMENTS

| | | | |
|---|---|---|---|
| CN | 107076372 | A | 8/2017 |
| CN | 207230478 | U | 4/2018 |
| CN | 208832192 | U | 5/2019 |

* cited by examiner

LIGHTING ASSEMBLY AND LIGHTING LAMP

CROSS-REFERENCE TO RELATED APPLICATIONS

This application is based upon and claims the priority of PCT patent application No. PCT/CN2019/118589 filed on Nov. 14, 2019 which claims priority to the Chinese patent application No. 201821877735.2 filed on Nov. 15, 2018, the entire content of all of which is hereby incorporated by reference herein for all purposes.

TECHNICAL FIELD

The present disclosure relates to the technical field of lighting devices, and particularly relates to a lighting assembly and a lighting lamp.

BACKGROUND

With the increasing demand of people for environmental lighting, the performance of lighting lamps has also been greatly improved. There are many kinds of lighting lamps, and a plurality of light emitting units (e.g., light-emitting diode (LED) light emitting units) can be arranged in the lighting lamps to form a larger illumination area.

SUMMARY

The present disclosure provides a lighting assembly and a lighting lamp.

The present disclosure provides a lighting assembly. The lighting assembly may include a light source assembly and a connection assembly. The light source assembly comprises a casing, a light source plate arranged on the casing, light emitting units arranged on the light source plate, and a first electrical terminal electrically connected with the light source plate. The first electrical terminal is connected to the casing. The connection assembly comprises a bracket, a connection rod mounted inside the bracket, and a second electrical terminal arranged at an end of the connection rod. The first electrical terminal and the second electrical terminal are in plugging and running fit to supply power to the light emitting units and to allow the light source assembly and the connection assembly to be in rotatable connection. A rotating shaft of the light source assembly and the connection assembly is parallel to an axis of the connection rod.

The present disclosure also provides a lighting lamp. The lighting lamp may include a lamp holder and a lighting assembly mounted on the lamp holder. The lighting assembly is the lighting assembly may include a light source assembly and a connection assembly. The light source assembly comprises a casing, a light source plate arranged on the casing, light emitting units arranged on the light source plate, and a first electrical terminal electrically connected with the light source plate. The first electrical terminal is connected to the casing. The connection assembly comprises a bracket, a connection rod mounted inside the bracket, and a second electrical terminal arranged at an end of the connection rod. The first electrical terminal and the second electrical terminal are in plugging and running fit to supply power to the light emitting units and to allow the light source assembly and the connection assembly to be in rotatable connection. A rotating shaft of the light source assembly and the connection assembly is parallel to an axis of the connection rod.

It is to be understood that both the foregoing general description and the following detailed description are exemplary and explanatory only and are not restrictive of the present disclosure.

BRIEF DESCRIPTION OF THE DRAWINGS

The accompanying drawings described herein are used to provide a further understanding of the present disclosure and form a part of the present disclosure. The schematic examples and descriptions of the present disclosure are used to explain the present disclosure and do not constitute an improper limitation on the present disclosure. In the drawings.

DETAILED DESCRIPTION

Figure 1:
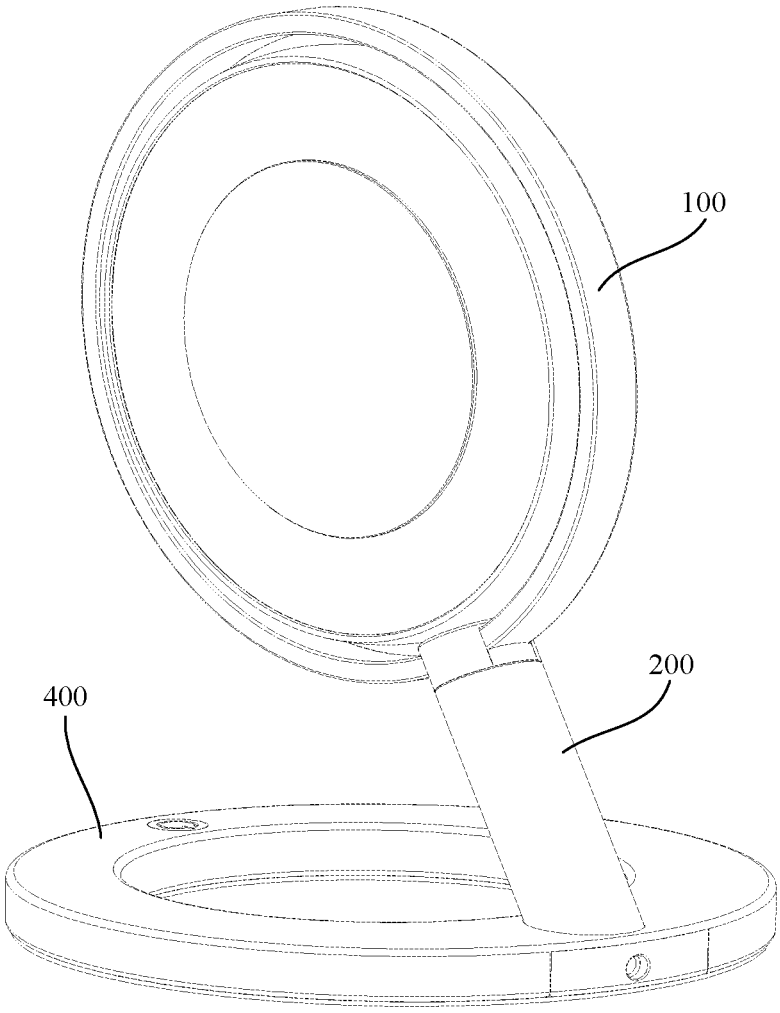
FIG. 1 is a schematic structural diagram of a lighting lamp disclosed by the examples of the present disclosure.
Figure 2:
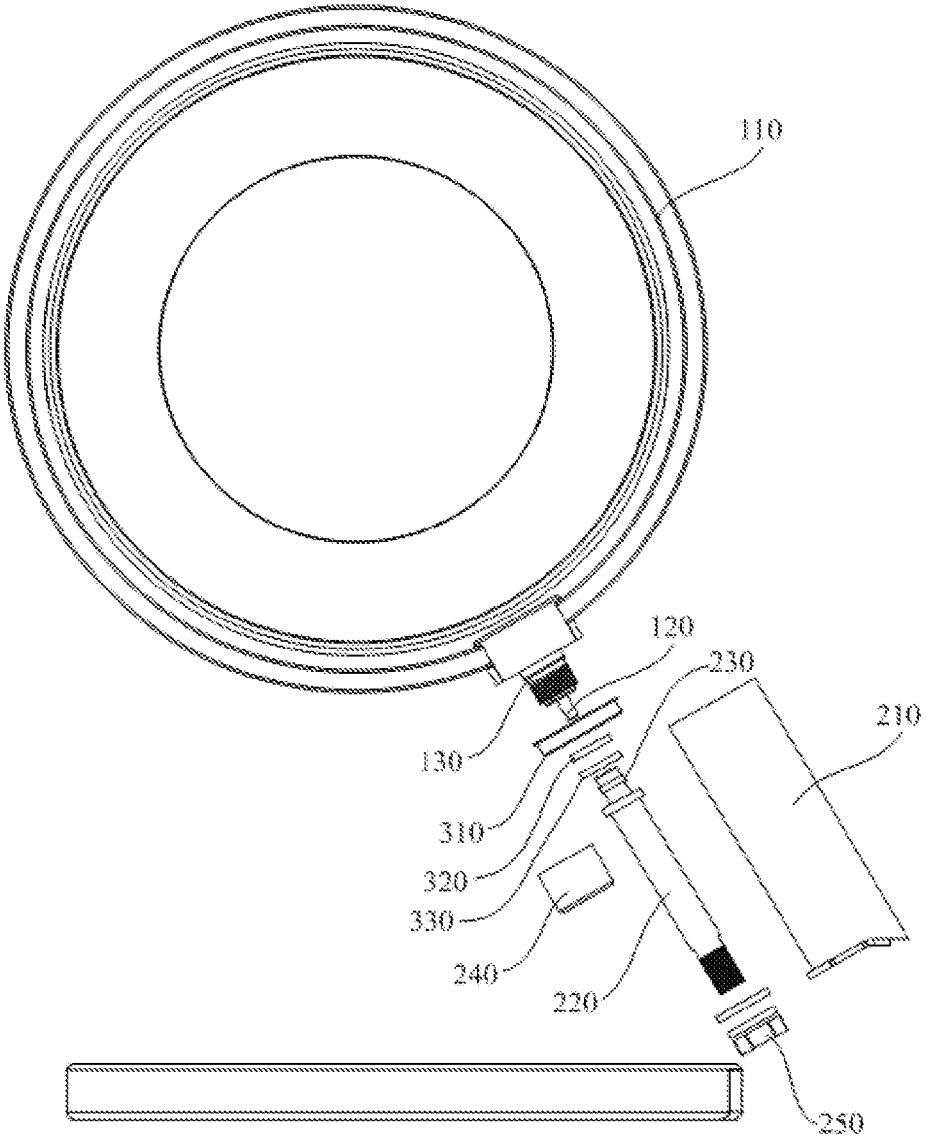
FIG. 2 is an exploded diagram of a lighting lamp disclosed by the examples of the present disclosure.
Figure 3:
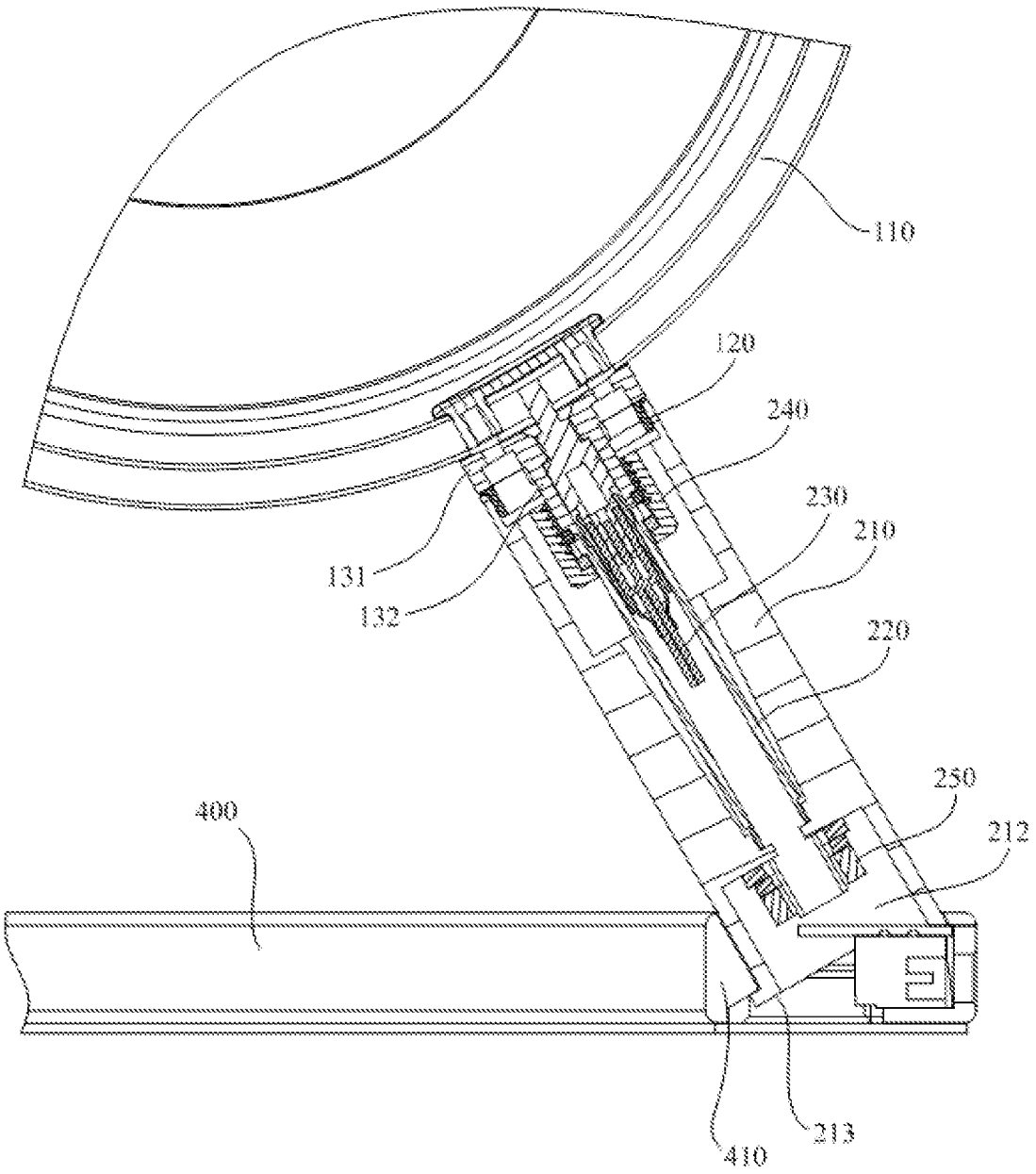
FIG. 3 is a partially sectional diagram of a lighting lamp disclosed by the examples of the present disclosure.

The examples are described in connection with the drawings related to the examples of the present disclosure. The described examples are just a portion but not all of the examples of the present disclosure. Based on the described examples herein, those skilled in the art can obtain other example(s), without any inventive work, which should be within the scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Description of reference numerals used in this disclosure may include:

100—light source assembly; 110—casing; 120—first electrical terminal; 130—connection base; 131—base body; 132—connection portion; 200—connection assembly; 210—bracket; 211—first groove; 212—second groove; 213—first clamping structure; 220—connection rod; 221—first positioning flange; 230—second electrical terminal; 240—top connection piece; 241—second positioning flange; 250—bottom connection piece; 310—first gasket; 311—flake-like portion; 312—cylindrical portion; 320—second gasket; 330—third gasket; 400—lamp holder; and 410—second clamping structure.

Taking a desk lamp as an example, the desk lamp generally includes a lamp holder, a light source assembly and a connection assembly for connecting the light source assembly to the lamp holder, and the light emitting units included in the light source assembly can emit light so as to meet the lighting requirement.

However, after the desk lamp is assembled, the position of the light source assembly relative to the lamp holder is unchangeable, so that the illumination area formed by the light emitting units is basically unchanged, and therefore, the desk lamp of this type can only illuminate in a single direction and cannot meet the multi-directional illumination requirements of users.

As illustrated in FIG. 1 to FIG. 4, the examples of the present disclosure disclose a lighting lamp. The lighting lamp can be a desk lamp, which comprises a lamp holder 400 and a lighting assembly mounted on the lamp holder 400. In the case where the lighting lamp is a desk lamp, the lamp holder 400 can be of a solid disk-shaped structure or a hollow disk-shaped structure. Of course, the lamp holder 400 may also be of other structures, as long as the installation of the lighting assembly can be realized and the lighting assembly can be stably placed at a predetermined position.

The above lighting assembly may specifically comprise a light source assembly 100 and a connection assembly 200. The light source assembly 100 is mainly used for emitting light, and the connection assembly 200 is mainly used for connecting the light source assembly 100 and the lamp holder 400. The light source assembly 100 comprises a casing 110, a light source plate (not illustrated in the figure) arranged on the casing 110, light emitting units (not illustrated in the figure) arranged on the light source plate, and a first electrical terminal 120 electrically connected to the light source plate. A plurality of light emitting units can be disposed on the light source plate, and the first electrical terminal 120 is connected to the casing 110 to transmit an electrical signal for driving the light emitting units to emit light. The connection assembly 200 comprises a bracket 210, a connection rod 220 mounted inside the bracket 210, and a second electrical terminal 230 arranged at an end of the connection rod 220. The first electrical terminal 120 and the second electrical terminal 230 are plugged to be electrically connected, and in running fit with each other, so as to supply power to the light emitting units and realize rotatable connection between the light source assembly 100 and the connection assembly 200. The rotating shaft of the light source assembly 100 and the connection assembly 200 are parallel to the axis of the connection rod 220.

In the above-mentioned lighting assembly, the first electrical terminal 120 and the second electrical terminal 230 are in plugging and running fit. On one hand, electricity can be supplied to the light emitting units, and on the other hand, the light source assembly 100 and the connection assembly 200 can be in rotatable connection. Therefore, when a user uses the lighting lamp, the user can rotate the light source assembly 100 freely to allow the position of the light source assembly 100 to randomly change relative to the connection assembly 200, and then the light exiting direction of the light source assembly 100 can be adjusted. Therefore, when adopting the lighting assembly, multi-directional illumination can be realized. Much further, a rotation angle of the light source assembly 100 can be an integral multiple of 360 degrees, so that the light source assembly 100 can form a circular rotation track, and can stay at any position on the circular rotation track.

The first electrical terminal 120 and the second electrical terminal 230 are ones of key structures for ensuring normal work of the lighting lamp, so the first electrical terminal 120 and the second electrical terminal 230 are maintained relatively fixed as much as possible after they are plugged in, and the reliability of electrical connection can be higher. However, the reliability of the electrical connection of the first electrical terminal 120 and the second electrical terminal 230 would be challenged in the case where mechanical connection and electrical connection are simultaneously realized only relying on the first electrical terminal 120 and the second electrical terminal 230.

Therefore, in an optional example, the light source assembly 100 also comprises a connection base 130 fixed on the casing 110, and the connection assembly 200 also comprises a top connection piece 240 which is connected to the exterior of the connection rod 220 in a sleeving manner. The connection base 130 is in detachable connection with the top connection piece 240. In this case, the first electrical terminal 120 can pass through the connection base 130 and be in plugging fit with the second electrical terminal 230. It can be seen that the connection base 130 and the top connection piece 240 may also realize mechanical connection between the light source assembly 100 and the connection assembly 200, so as to prevent the phenomenon that the first electrical terminal 120 and the second electrical terminal 230 are damaged because of relative movement due to the action of an external force.

The top connection piece 240 can be located outside the bracket 210, and may also be located inside the bracket 210. In the case where the later setting mode is adopted, the bracket 210 may cover a connection position of the connection base 130 and the top connection piece 240, so that the connection position can be prevented from being destroyed by an external force, and the appearance quality of the whole lighting lamp can be improved as well.

There are many connection modes for the connection base 130 and the top connection piece 240. For example, the connection base 130 and the top connection piece 240 can be in clamping connection, threaded connection, or the like. Considering that the connection mode would affect the reliability of the connection between the first electrical terminal 120 and the second electrical terminal 230, thread fit between the connection base 130 and the top connection piece 240 is preferred in the examples of the present disclosure. Furthermore, in the case where the thread fit is adopted, the plugging amplitude of the first electrical terminal 120 and the second electrical terminal 230 can also be adjusted appropriately to ensure that the two electrical terminals are reliably electrically connected and the relative rotation of the two electrical terminals is more smoothly.

In the examples, the connection base 130 comprises a base body 131 and a connection portion 132 arranged on the base body 131. The bracket 210 and the base body 131 are opposite along an axial direction of the connection rod 220. The connection portion 132 protrudes relative to the base body 131, and is located inside the bracket 210. The base body 131 can be butted with the bracket 210, so that the connection position of the light source assembly 100 and the connection assembly 200 is transitioned more smoothly, and the whole lighting lamp is higher in appearance quality. The connection portion 132 protrudes relative to the base body 131, which facilities the connection between the connection base 130 and the top connection piece 240. In the case where the connection base 130 and the top connection piece 240 are in thread fit, the connection portion 132 can be provided with an external thread to be in thread fit with the top connection piece 240.

The base body 131 can be directly butted with the bracket 210, that is, the base body 131 and the bracket 210 are in direct contact, or a relatively small gap is formed between the base body 131 and the bracket 210. In the case where the base body 131 and the bracket 210 are in direct contact, once the lighting lamp is stressed by an external force to cause a relative offset between the base body 131 and the bracket 210, the base body 131 and the bracket 210 may have indentations due to extremely high local stress. In the case where the relatively small gap is reserved between the base body 131 and the bracket 210, impurities such as dust in an external environment may easily enter the bracket 210 to affect the electrical conduction reliability of the first electrical terminal 120 and the second electrical terminal 230. For this purpose, in the examples of the present disclosure, the lighting assembly also comprises a first gasket 310, and at least part of the first gasket 310 is arranged between the base body 131 and the bracket 210. That is, the relatively small gap can be reserved between the base body 131 and the bracket 210, and then at least part of the first gasket 310 fills this gap. The first gasket 310 has certain elasticity, so that the first gasket 310 may adapt to offset by means of its deformation even if relative offset occurs between the base body 131 and the bracket 210, and the base body 131 and the bracket 210 would not be affected basically. Meanwhile, the impurities in the external environment may also be blocked by the first gasket 310, thereby ensuring the electrical conduction reliability of the first electrical terminal 120 and the second electrical terminal 230.

In order to further improve the relative position precision after the light source assembly 100 and the connection assembly 200 are connected, an end, facing the base body 131, of the bracket 210 can be provided with a first groove 211. The first gasket 310 comprises a flake-like portion 311 and a cylindrical portion 312 which are connected with each other. The flake-like portion 311 is located between the base body 131 and the bracket 210, and the cylindrical portion 312 is located in the first groove 211. The first electrical terminal 120 passes through the cylindrical portion 312, and is in plugging fit with the second electrical terminal 230. The flake-like portion 311 may fill the gap between the base body 131 and the bracket 210. In the case where a relative offset occurs between the base body 131 and the bracket 210, the cylindrical portion 312 resists against the bracket 210 to limit the amplitude of the relative offset between the base body 131 and the bracket 210, so as to achieve the foregoing objective.

The maximum size of the flake-like portion 311 in the axial direction of the connection rod 220 is the thickness of the flake-like portion 311, and the maximum size of the cylindrical portion 312 in the axial direction is the length of the cylindrical portion 312. The thickness of the flake-like portion 311 does not need to be extremely great, as long as the flake-like portion 311 can exert the effects of absorbing an external force and blocking the external impurities. The length of the cylindrical portion 312 can be set to be relatively great to form a relatively large resisting area against the bracket 210 so as to enhance the limiting effect. Accordingly, in the examples of the present disclosure, a ratio of the length of the cylindrical portion 312 to the thickness of the flake-like portion 311 is set to range from 5 to 10.

In order to realize the connection between the connection rod 220 and the top connection piece 240 through a simpler structure, an end, facing the base body 131, of the connection rod 220 can be provided with a first positioning flange 221, and an end, away from the casing 110, of the top connection piece 240 is provided with a second positioning flange 241. The first positioning flange 221 and the second positioning flange 241 are in location fit in the axial direction of the connection rod 220.

Figure 4:
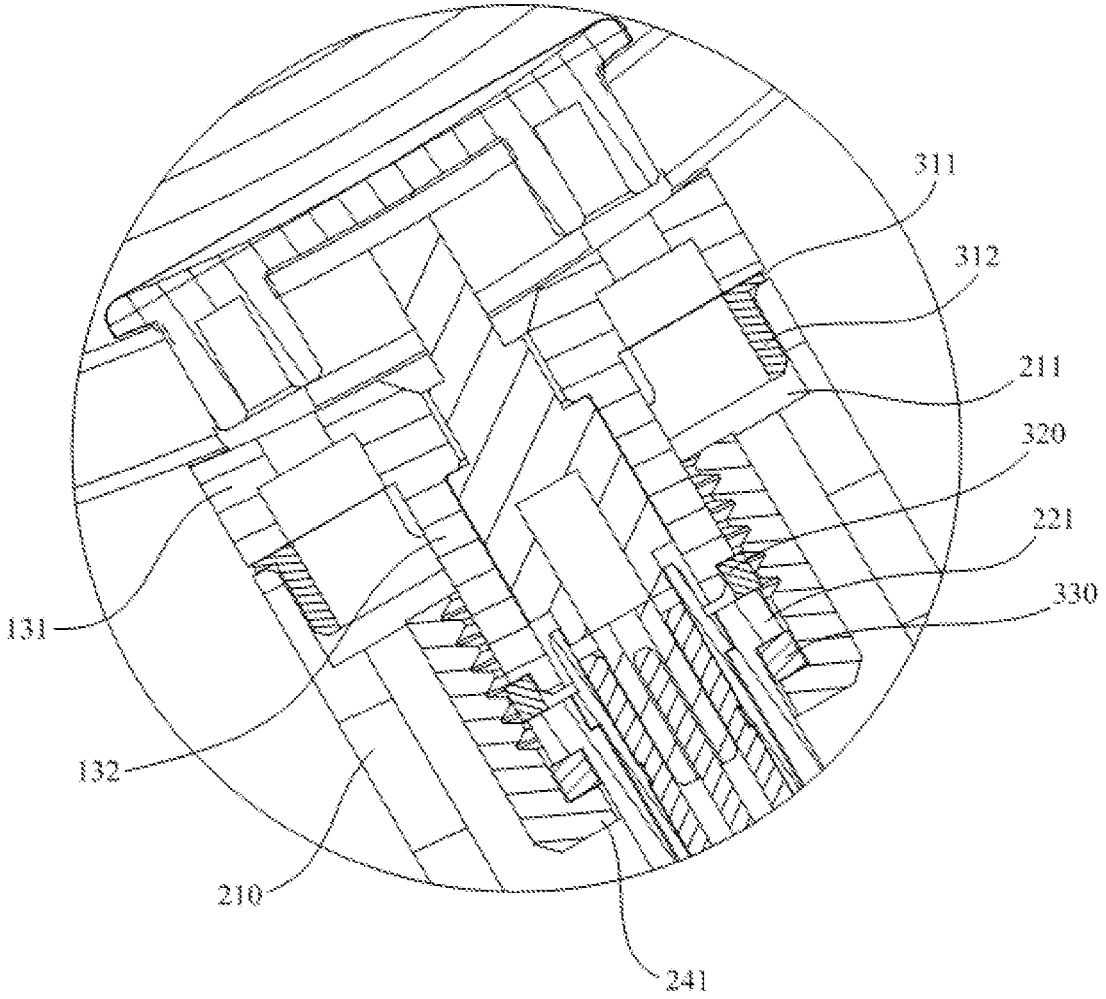
FIG. 4 is a partially enlarged diagram of FIG. 3.

Further, referring to FIG. 4, similar to the foregoing first gasket 310, a second gasket 320 can also be provided. The second gasket 320 is provided between the base body 131 and the first positioning flange 221 to allow the relative position between the base body 131 and the connection rod 220 to change a little, so as to adapt to the assembling error and an external force stressed in a use process, thereby ensuring the connection reliability. Much further, a third gasket 330 can also be provided. The third gasket 330 is arranged between the first positioning flange 221 and the second positioning flange 241 to allow the relative position between the connection rod 220 and the top connection piece 240 to change a little, so as to adapt to the assembling error and an external force stressed in a use process, thereby ensuring the connection reliability.

The connection solutions between the top connection piece 240 and the light source assembly 100 as well as between the bracket 210 and the light source assembly 100 are described above. In order to further improve the connection reliability between the light source assembly 100 and the connection assembly 200, the connection assembly 200 in the examples of the present disclosure may also comprise a bottom connection piece 250. The bottom connection piece 250 is in thread fit with the connection rod 220, and in the axial direction of the connection rod 220, the bracket 210 is in location fit with the bottom connection piece 250. Because the top of the connection rod 220 is connected with the top connection piece 240, an acting force can be applied to the bracket 210 through the bottom connection piece 250 so as to allow the bracket 210 to be reliably positioned between the light source assembly 100 and the lamp holder 400.

In the case where the light source assembly 100 is provided with the connection base 130, the bracket 210 can be pressed with the connection base 130 more tightly together under the action of the bottom connection piece 250, thereby realizing more reliable connection.

The position, connected with the bottom connection piece 250, of the bracket 210 is closer to the lamp holder 400, so an end, away from the casing 110, of the bracket 210 can be provided with a second groove 212 to prevent interference between the bottom connection piece 250 and the lamp holder 400, and the bottom connection piece 250 is located in the second groove 212.

There are many choices for connection modes between the bracket 210 and the lamp holder 400. For example, a threaded fastener can be used for connection, and a clamping structure can also be used for connection, or connection structures in other forms can be used. Considering that a clamping mode may allow the installation of the bracket 210 to be more convenient and quicker, the examples of the present disclosure prefer that the bracket 210 is clamped to the lamp holder 400. Specifically, an end, away from the casing 110, of the bracket 210 is provided with a first clamping structure 213, and the lamp holder 400 is provided with a second clamping structure 410. The first clamping structure 213 and the second clamping structure 410 are clamped with each other to realize clamping between the bracket 210 and the lamp holder 400.

In order to meet the brightness requirement and the appearance requirement of users for the lighting lamp, the casing 110 can be set to be of a disk structure. The middle portion of the disk structure can be hollowed to allow both the light source plate and the light emitting units to be located in the middle portion of the disk structure, so that the aesthetic degree can also be increased on the premise of meeting the layout requirement of the light emitting units. Specifically, a plurality of light emitting unit groups can be distributed on the light source plate in a spacing manner, and each light emitting unit group comprises a plurality of light emitting units arranged in a spacing manner along a circumferential direction of the casing 110.

The connection rod 220 can be connected to the edge of the disk structure, and the optical axis of each light emitting unit is parallel to the axial direction of the disk structure. The light emitted by the light emitting units faces one side of the disk structure. In the case where the light source assembly 100 rotates around the connection assembly 200, the light emitted by the light emitting units can change at 360 degrees around the connection assembly 200, so as to meet the demands of the users.

The present disclosure provides a lighting assembly and a lighting lamp, which can meet the multi-directional illumination requirements of users.

A lighting assembly comprises a light source assembly and a connection assembly. The light source assembly comprises a casing, a light source plate arranged on the casing, light emitting units arranged on the light source plate, and a first electrical terminal electrically connected with the light source plate. The first electrical terminal is connected to the casing. The connection assembly comprises a bracket, a connection rod mounted inside the bracket, and a second electrical terminal arranged at an end of the connection rod. The first electrical terminal and the second electrical terminal are in plugging and running fit to supply power to the light emitting units and to allow the light source assembly and the connection assembly to be in rotatable connection. A rotating shaft of the light source assembly and the connection assembly is parallel to an axis of the connection rod.

A lighting lamp comprises a lamp holder and a lighting assembly mounted on the lamp holder. The lighting assembly is the lighting assembly described above.

The technical solution adopted in the present disclosure can achieve the following beneficial effects.

In the lighting assembly disclosed by the present disclosure, the first electrical terminal and the second electrical terminal are in plugging and running fit. On one hand, electricity can be supplied to the light emitting units, and on the other hand, the light source assembly and the connection assembly can be in rotatable connection. Therefore, when a user uses the lighting lamp, the user can rotate the light source assembly freely to allow the position of the light source assembly to randomly change relative to the connection assembly, and then the light exiting direction of the light source assembly can be adjusted. Therefore, when using the lighting assembly, multi-directional illumination can be realized.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above examples of the present disclosure focus on the differences between the various examples. As long as the different optimized features between the various examples are not contradictory, they can be combined to form better examples. Considering the simplicity of the text, no more repeated descriptions are provided here.

The above contents are only the examples of the present disclosure, but not intended to limit the present disclosure. Those skilled in the art can make various changes and modifications to the present disclosure. Any modifications, equivalent replacements, improvements and the like that are made without departing from the spirit and the principle of the present disclosure shall all fall within the scope of the present disclosure.

What is claimed is:

1. A lighting assembly, comprising a light source assembly and a connection assembly, wherein:

the light source assembly comprises a casing, a light source plate arranged on the casing, light emitting units arranged on the light source plate, and a first electrical terminal electrically connected with the light source plate;

the first electrical terminal is connected to the casing;

the connection assembly comprises a bracket, a connection rod mounted inside the bracket, and a second electrical terminal arranged at an end of the connection rod;

the first electrical terminal and the second electrical terminal are in plugging and running fit to supply power to the light emitting units and to allow the light source assembly and the connection assembly to be in rotatable connection, wherein the light source assembly and the connection assembly are rotatably connected along an axis of the connection assembly; and a rotating shaft of the light source assembly and the connection assembly is parallel to an axis of the connection rod, and the light source assembly is configured to form a circular rotation around the axis of the connection rod.

2. The lighting assembly according to claim 1, wherein:

the light source assembly further comprises a connection base fixed on the casing, and the connection assembly further comprises a top connection piece;

the top connection piece is connected to an exterior of the connection rod in a sleeving manner; and the connection base is in detachable connection with the top connection piece.

3. The lighting assembly according to claim 2, wherein the top connection piece is inside the bracket.

4. The lighting assembly according to claim 2, wherein:

the connection base comprises a base body and a connection portion arranged on the base body;

the bracket and the base body are opposite along an axial direction of the connection rod;

the connection portion protrudes relative to the base body, and is inside the bracket; and the connection portion is provided with an external thread and is in thread fit with the top connection piece.

5. The lighting assembly according to claim 4, further comprising a first gasket, wherein at least part of the first gasket is between the base body and the bracket.

6. The lighting assembly according to claim 5, wherein:

an end, facing the base body, of the bracket is provided with a first groove;

the first gasket comprises a flake-like portion and a cylindrical portion that are connected with each other;

the flake-like portion is between the base body and the bracket; and the cylindrical portion is in the first groove.

7. The lighting assembly according to claim 6, wherein:

a maximum size of the flake-like portion in the axial direction is a thickness of the flake-like portion, and a maximum size of the cylindrical portion in the axial direction is a length of the cylindrical portion; and a ratio of the length of the cylindrical portion to the thickness of the flake-like portion ranges from 5 to 10.

8. The lighting assembly according to claim 4, wherein:

an end, facing the base body, of the connection rod is provided with a first positioning flange;

an end, away from the casing, of the top connection piece is provided with a second positioning flange; and the first positioning flange and the second positioning flange are in location fit in the axial direction.

9. The lighting assembly according to claim 8, further comprising:

a second gasket, wherein the second gasket is between the base body and the first positioning flange, or a third gasket, wherein the third gasket is between the first positioning flange and the second positioning flange.

10. The lighting assembly according to claim 1, wherein:

the connection assembly further comprises a bottom connection piece;

the bottom connection piece and the connection rod are in thread fit; and in an axial direction of the connection rod, the bracket and the bottom connection piece are in location fit.

11. The lighting assembly according to claim 10, wherein an end, away from the casing, of the bracket is provided with a second groove, and the bottom connection piece is in the second groove.

12. The lighting assembly according to claim 1, wherein an end, away from the casing, of the bracket is provided with a first clamping structure, and the first clamping structure is used for being clamped with a second clamping structure of a lamp holder.

13. The lighting assembly according to claim 1, wherein the casing is of a disk structure.

14. The lighting assembly according to claim 13, wherein the connection rod is connected to an edge of the disk structure; both the light source plate and the light emitting units are in a middle portion of the disk structure; and a light axis of each light emitting unit is parallel to an axial direction of the disk structure.

15. A lighting lamp, comprising a lamp holder and a lighting assembly mounted on the lamp holder, wherein the lighting assembly comprises a light source assembly and a connection assembly, and wherein:

the light source assembly comprises a casing, a light source plate arranged on the casing, light emitting units arranged on the light source plate, and a first electrical terminal electrically connected with the light source plate;

the first electrical terminal is connected to the casing;

the connection assembly comprises a bracket, a connection rod mounted inside the bracket, and a second electrical terminal arranged at an end of the connection rod;

the first electrical terminal and the second electrical terminal are in plugging and running fit to supply power to the light emitting units and to allow the light source assembly and the connection assembly to be in rotatable connection, wherein the light source assembly and the connection assembly are rotatably connected along an axis of the connection assembly; and a rotating shaft of the light source assembly and the connection assembly is parallel to an axis of the connection rod, and the light source assembly is configured to form a circular rotation around the axis of the connection rod.

16. The lighting lamp according to claim 15, wherein the lighting lamp is a desk lamp.

* * * * *